US006674543B2

(12) United States Patent
Day et al.

(10) Patent No.: US 6,674,543 B2
(45) Date of Patent: Jan. 6, 2004

(54) MANUALLY POSITIONED PRINTER WITH AN ALIGNMENT MEANS

(75) Inventors: Robert Charles Lewis Day, Hertfordshire (GB); Jonathan Kemp, Cambridge (GB); Adrian Michael Woodward, Hertfordshire (GB); Lawrence Archard, Cambridge (GB); Robert Charles Sims, Hertfordshire (GB); Geert Heyse, Sint Katelijne Waver (BE); Michel Woodman, Cambridgeshire (GB); Chris McCleve, London (GB); Martin Gibbs, East Sussex (GB)

(73) Assignee: Esselte N.V., Sint-Niklaas (BE)

( * ) Notice: Subject to any disclaimer, the term of this patent is extended or adjusted under 35 U.S.C. 154(b) by 0 days.

(21) Appl. No.: 09/853,804

(22) Filed: May 14, 2001

(65) Prior Publication Data

US 2002/0030830 A1 Mar. 14, 2002

Related U.S. Application Data

(63) Continuation of application No. PCT/GB99/03539, filed on Oct. 26, 1999.

(30) Foreign Application Priority Data

Nov. 13, 1998 (GB) ..... 9825018

(51) Int. Cl.[7] ..... G06F 15/00

(52) U.S. Cl. ..... 358/1.8; 358/45; 358/451; 400/29; 400/88

(58) Field of Search ..... 358/1.8, 451, 450; 400/29, 88, 120.02; 345/163; 346/143

(56) References Cited

U.S. PATENT DOCUMENTS 3,901,372 A * 8/1975 Denley ..... 400/690.1
4,193,684 A * 3/1980 Armstrong ..... 355/40
4,819,083 A * 4/1989 Kawai et al. ..... 358/451

(List continued on next page.)

FOREIGN PATENT DOCUMENTS

| | | | |
|---|---|---|---|
| EP | 0 376 326 A2 | 7/1990 | ..... G06K/15/00 |
| EP | 0 564 297 A2 | 10/1993 | ..... B41J/3/36 |
| EP | 0598 251 A1 | 10/1993 | ..... B41K/1/14 |
| GB | 2 236 985 A | 4/1991 | ..... B41J/3/28 |
| JP | 57 195671 | 12/1982 | ..... B41J/3/28 |
| JP | 61 175056 | 12/1986 | ..... B41J/3/28 |

(List continued on next page.)

OTHER PUBLICATIONS

International Preliminary Search Report, dated Jan. 27, 2000 for PCT/GB99/03539.

Search report from United Kingdom Appl. No. 9825018.6, dated Jan. 19, 1999.

*Primary Examiner*—Edward Coles
*Assistant Examiner*—Twyler Lamb
(74) *Attorney, Agent, or Firm*—Pennie & Edmonds LLP

(57) ABSTRACT

A printer with a housing arranged to be manually positioned on an image receiving medium. In order to allow easy alignment, a window is provided such that the print face is visible through the window. A controller of the printer is operable to detect markings on an image receiving medium, the markings being scanned by means of a scanner. An indicator referring to a direction in which the printer is to be moved and the detected markings are displayed in order to obtain alignment between the print face and the detected markings. The printer uses a medium with alignment marks, or alternately prints alignment marks onto a medium. Finally, a base station with an adjustable stop for positioning a print medium is included.

25 Claims, 6 Drawing Sheets

U.S. PATENT DOCUMENTS

| | | | | | |
|---|---|---|---|---|---|
| 4,949,283 | A | | 8/1990 | Yamaguchi et al. | 364/519 |
| 5,063,451 | A | * | 11/1991 | Yanagisawa et al. | 346/143 |
| 5,308,173 | A | * | 5/1994 | Amano et al. | 400/29 |
| 5,311,208 | A | * | 5/1994 | Burger et al. | 345/163 |
| 5,478,157 | A | * | 12/1995 | Kohno et al. | 400/120.02 |
| 5,634,730 | A | * | 6/1997 | Bobry | 400/88 |
| 5,685,651 | A | | 11/1997 | Hayman et al. | 400/88 |
| 5,825,995 | A | | 10/1998 | Wiklof et al. | 395/117 |
| 6,398,432 | B1 | * | 6/2002 | Day et al. | 400/88 |

FOREIGN PATENT DOCUMENTS

| | | | | |
|---|---|---|---|---|
| JP | 63 053084 | | 3/1988 | B41J/21/00 |
| JP | 62 179965 | | 8/1988 | B41J/3/28 |
| JP | 02 026769 | | 1/1990 | B41J/3/28 |
| JP | 03 143657 | | 6/1991 | B41J/3/28 |
| JP | 05108278 | | 4/1993 | G06F/3/09 |
| JP | 09 109466 | | 4/1997 | B41J/3/28 |
| JP | 09 131927 | | 5/1997 | B41J/3/28 |
| JP | 9131927 | A | 5/1997 | B41J/3/28 |
| JP | 09 286139 | | 11/1997 | B41J/3/28 |
| WO | WO 86 05142 | | 9/1986 | B41J/3/36 |

* cited by examiner

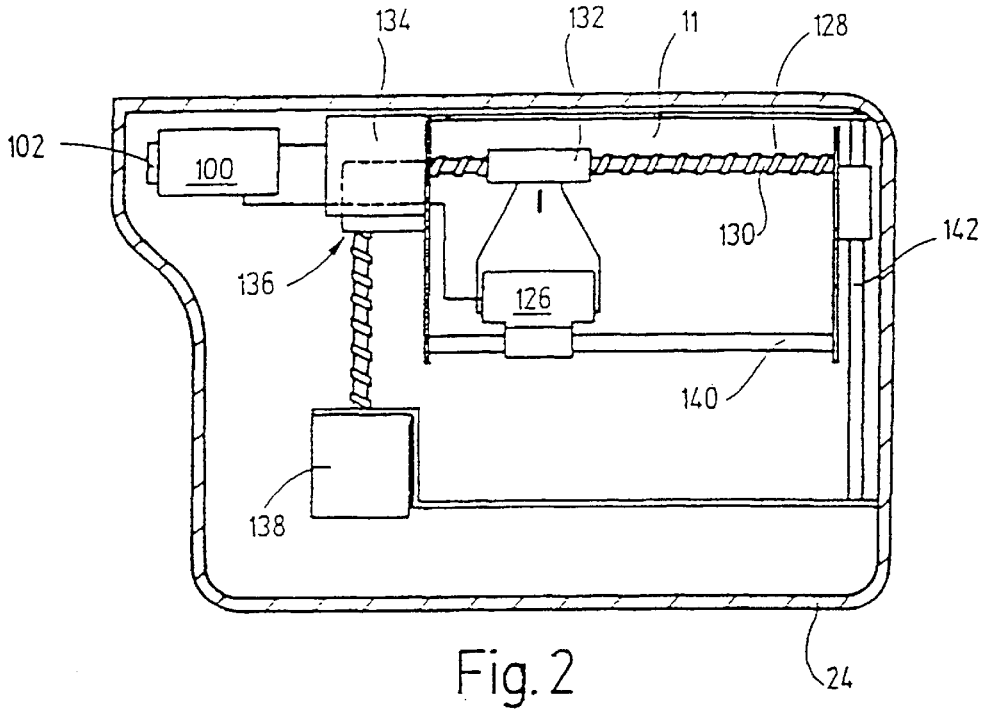
Fig. 2
Fig. 3
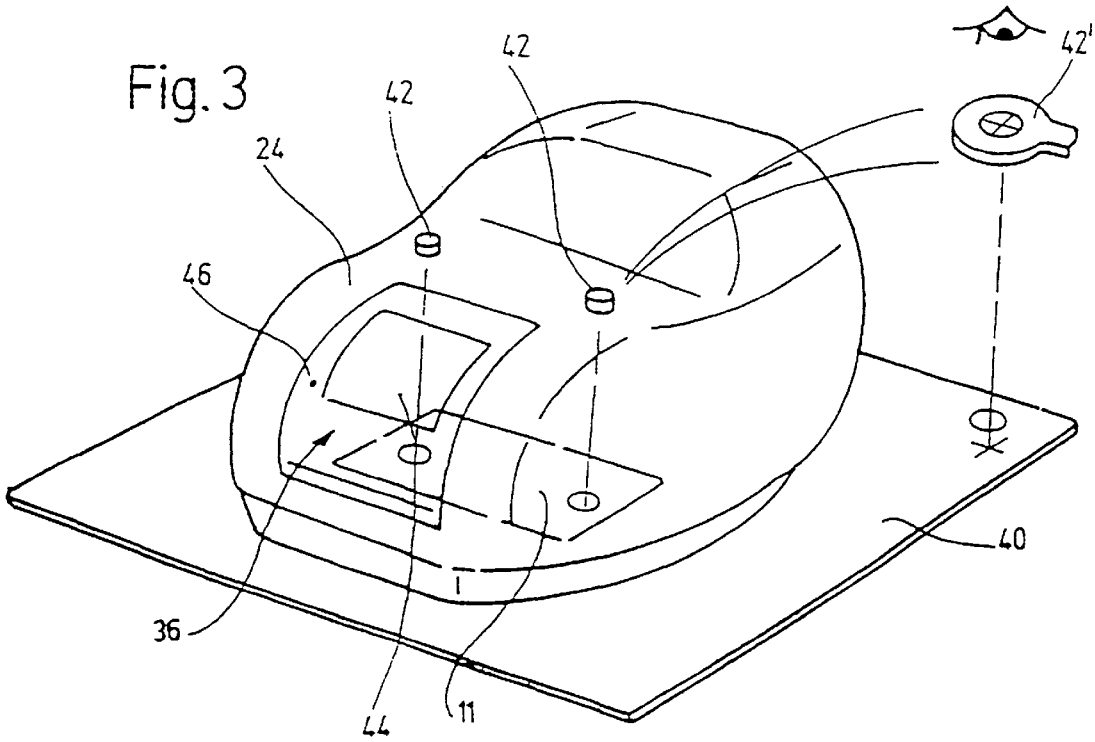

MANUALLY POSITIONED PRINTER WITH AN ALIGNMENT MEANS

CROSS-REFERENCE TO RELATED APPLICATIONS

This application is a continuation of copending International Application No. PCT/GB99/03539, filed Oct. 26, 1999.

FIELD OF THE INVENTION

The present invention relates to a printer. More particularly, the invention relates to a printer that is manually positionable on a image receiving medium for printing thereon or for detecting markings thereon.

BACKGROUND OF THE INVENTION

In the state of the art, a number of printers are known that may be manually placed on an image receiving medium. The printing means of the printer or the entire printer is operable to scan over the image receiving medium in the printing operation. Thus, the medium is not fed through the printer—as in most office sheet printers, but the printer is placed upon the medium.

Such a printer is known from EP 564297 A. The printer disclosed in this reference has an ink jet print head which scans in two orthogonal directions over the image receiving medium, onto which the printer is manually placed. The printer is connected to a computer and capable, e.g., of printing addresses onto envelopes, but can also be used separately from the computer for printing data downloaded from the computer to the printer.

Another ink jet printer to be placed on a printing medium is disclosed in U.S. Pat. No. 5,634,730. This printer is provided with a keyboard for data inputting, but can also print images downloaded from a computer. The print head scans over the image receiving medium along a special path, e.g., helically or like a pendulum.

DE 3142937 A refers to a so-called hand stamp which is placed manually on the image receiving medium. It can print data downloaded from an accounting machine, or images consisting of user-selected fixed phrases. The hand stamp has a thermal print.

U.S. Pat. No. 5,063,451 discloses another printing apparatus which can be placed on an object and print a selected pattern by means of a scanning print head onto the surface of the object. In order to make an alignment of the printer on the printed object easier, the printer is provided with a frame member having a window through which printing is performed. Thus, the frame member is positioned such that the window is aligned in the desired printing location and then the printing mechanism is placed in its active position. Thus, the printing mechanism is movably (hinged or slidably) mounted to the frame member.

U.S. Pat. No. 4,436,439 discloses a small printer in which the image receiving medium is fed through the printer and the printed image can be viewed through a window. This printer has an ink jet print head mounted on a crank.

The printers known in the prior art are thus capable of printing an image onto an image receiving medium, and make use of a scanning print head. Printing is performed in two steps: the first one is alignment of the printer on the image receiving medium such that the image can be printed in the desired position. The second step is printing. In the prior art, alignment of the printer in the appropriate printing position is somewhat difficult, since the known direct printers do not allow viewing the image receiving medium when the printer is in position (EP 564297, U.S. Pat. No. 5,634,730, DE 3142937), or require closing of the printer after aligning (U.S. Pat. No. 5,063,451), such that the printer may accidentally slip out of the desired printing position during closing, but the user cannot notice this movement, such that printing is not always performed with perfect alignment.

The object of the present invention is hence to provide a printer of the type which is manually placed on an image receiving medium which allows an easy alignment.

SUMMARY OF THE INVENTION

According to a first aspect of the invention, there is provided a printer includes a housing arranged to be manually positioned on an image receiving medium. The housing is provided with a window, the window being arranged such that the print face is visible through the window. The printer also includes a print head provided in the housing and a print face exposed to the image receiving medium, the print face defining a region in which the print head is operable to print a desired pattern onto the image receiving medium. The printer further comprises a base station for receiving the housing when the printer is not in use, whereby the print head is protected.

The core of this aspect of the invention is thus to have a window in the housing of the printer, such that a user can see the print face and the image receiving medium.

According to another aspect of the invention, there is provided a printer including a housing arranged to be manually positioned on an image receiving medium; a print head provided in the housing; and a print face exposed to the image receiving medium. The print face defines a region in which the print head is operable to print a desired pattern onto the image receiving medium. The window is arranged such that the print face is visible through the window.

The core of this aspect of the invention is to have a window in the housing of the printer, such that a user can see the print face and the image receiving medium through the window. Since the boundaries of the print face as well as the medium are visible, it is easy for the user to move the printer over the image receiving medium until perfect alignment is obtained. Then the printing sequence can be initiated.

In a preferred embodiment of the invention, a means is provided for projecting a light spot onto the image receiving medium. Thus, alignment is made even easier for the user. These means can be a LED with a focusing lens, and/or a solid state laser. Preferably, two light spots are projected onto the image receiving medium, so that an imaginary line connecting both spots is oriented parallel to an edge of the print face.

Alternatively or additionally to the light spot, it is proposed to include a sighting arrangement within the housing of the printer, the sighting arrangement arranged such that the print face (and thus the image receiving medium) can be seen through it, and comprising two vertically separated reference features, preferably crosshairs. The user can thus look through the sighting arrangement and align the printer with the image receiving medium. Here, it is also preferred that two sighting arrangements are provided, so that an imaginary line connecting both sighting arrangements is oriented parallel to an edge of the print face.

The window can comprise a first area and a second area, the first area being clear and the second area being frosted. The first area is preferably approximately rectangular arid surrounded by the second area. Thus, the user can view through the window and the first area he or she sees corresponds to the print face, at least when viewed from a larger distance from the housing. Preferably, a window having a frosted area is provided in a printer having a sighting arrangement (e.g., crosshairs) within the housing, which can be seen through the window. In this case, alignment errors caused by parallax can be even further reduced.

The window is preferably hingedly mounted to the housing, and may comprise two parts, which are hingedly mounted together. Alternatively, the window is releasably mounted to the housing.

In another embodiment of the invention, the print face is surrounded by a thin fixed guide, the guide being sufficiently thin to allow a movement of the print head within the print face, and visible through the window. Thus, the user can easily align the guide with the image receiving medium, in another embodiment, the print face is surrounded by hingedly mounted print area guides, the print area guides being biased such that they are normally aligned vertically upstanding from a plane defined by a print face, and arranged to be moved aside by the print head (during a printing sequence), and the print area guides being visible through the window. The thin fixed guide or the hinged print area guides allow a full range of travel of the print head—which is normally an ink jet print head and thus has to move close to the image receiving medium, at a distance smaller than the thickness of the bottom part of the housing of the printer—over the print face, since they are designed to be sufficiently thin or flexible so as not to block the print head, but exactly indicate the boundaries of the print face.

According to another aspect of the invention, there is provided a printer including a housing arranged to be manually positioned on an image receiving medium; a print head provided in the housing; and a print face exposed to the image receiving medium. The print head is movable within the housing to print a desired pattern onto the image receiving medium in the region of the print face. The printer also includes a scanner operable to scan the print face and a controller connected to the scanner, the print head and a display, the display being provided within the housing of the printer or external to the printer. The controller is operable to detect markings on the image receiving medium, the markings being scanned by means of the scanner. The controller is operable to display an information referring to a direction in which the printer is to be moved in order to obtain alignment between the print face and the detected markings.

Thus, after placing the printer on an image receiving medium, the scanner first of all scans the surface of the image receiving medium adjacent the print face. This can be performed upon detection that the printer contacts the medium, or when a corresponding button has been depressed. The scanner produces image data, and the controller checks whether they include, for example, a horizontal or vertical straight line, or another special marking, such as a cross, which is defined by an intersection of two lines. The controller controls a display which indicates to the user in which direction the printer has to be moved in order to align it with the detected marking on the image receiving medium. The display may show arrows indicating the appropriate direction and/or flashing elements as LEDs to indicate in which direction to move (translate and/or rotate) the printer.

In principle, it would be possible to scan the image receiving medium repeatably after the user has moved the printer according to the displayed information, in order to check whether movement and thus alignment has been performed appropriately. Since this is somewhat time consuming, it is proposed that two spaced mouse balls are provided adjacent the print face, the mouse balls being connected to the controller and submitting an information regarding a relative movement between the printer and the image receiving medium to the controller, and the controller being operable to compare the movement measured by the mouse balls with a movement calculated by means of data obtained by the scanner and operable to display an information when the printer has been brought in a position in which the print face is aligned with the detected markings.

According to a third aspect of the invention, there is provided a combination of an image receiving medium and a printer, the printer including a housing arranged to be manually positioned on an image receiving medium; a print head provided in the housing; and a print face exposed to the image receiving medium, the print face defining a region in which the print head is operable to print a desired pattern onto the Image receiving medium. The image receiving medium is provided with pre-printed or punched alignment marks for aligning the printer to the image receiving medium.

The pre-printed or punched alignment marks make alignment of the printer on the image receiving medium easier. The image receiving medium can be a strip of labels. According to a fourth aspect of the invention, there is provided a combination of an image receiving medium and a printer, wherein the image receiving medium is an ID card, and the printer includes a housing arranged to be positioned on the ID card; a print head provided in the housing; and a print face exposed to the ID card, the print face defining a region in which the print head is operable to print a desired pattern onto the ID card. The printer prints assignment marks onto the ID card, the alignment marks being provided for alignment of the ID card in subsequent lamination.

The image receiving medium is preferably an ID card, and the alignment marks are provided for alignment of the ID card in a subsequent lamination process.

According to a fifth aspect of the invention, there is provided a combination of a base station and a printer, the printer including a housing arranged to be positioned on an image receiving medium; a print head provided in the housing; and a print face exposed to the image receiving medium, the print face defining a region in which the print head is operable to print a desired pattern onto the image receiving medium. The printer is arranged to be positioned on the base station, and the base station is provided with a stop arranged to align a print medium on the base station with respect to the printer. The position of the stop is adjustable and has a number of predetermined positions at which the stop can be arrested.

Thus, it is possible to adjust the stop according to the size of the medium to be printed. The medium is then placed upon or inserted into the base station (on which also the printer is placed, either before or after insertion of the image receiving medium), and aligned with the stop. Thus, printing can easily be performed at the desired position on the image receiving medium. Since the stop is adjustable, e.g., like a stop in a hole puncher, it can be simply adjusted to the size of the medium to be printed.

BRIEF DESCRIPTION OF THE DRAWINGS

For a better understanding of the present invention and as to show how the same may be carried into effect, reference will now be made to the accompanying drawings in which:

FIG. 2 is a plan view of the printing mechanism of the printer;

FIG. 3 is a view of a printer with an aligning means:

DETAILED DESCRIPTION OF THE PREFERRED EMBODIMENTS

Figure 1:
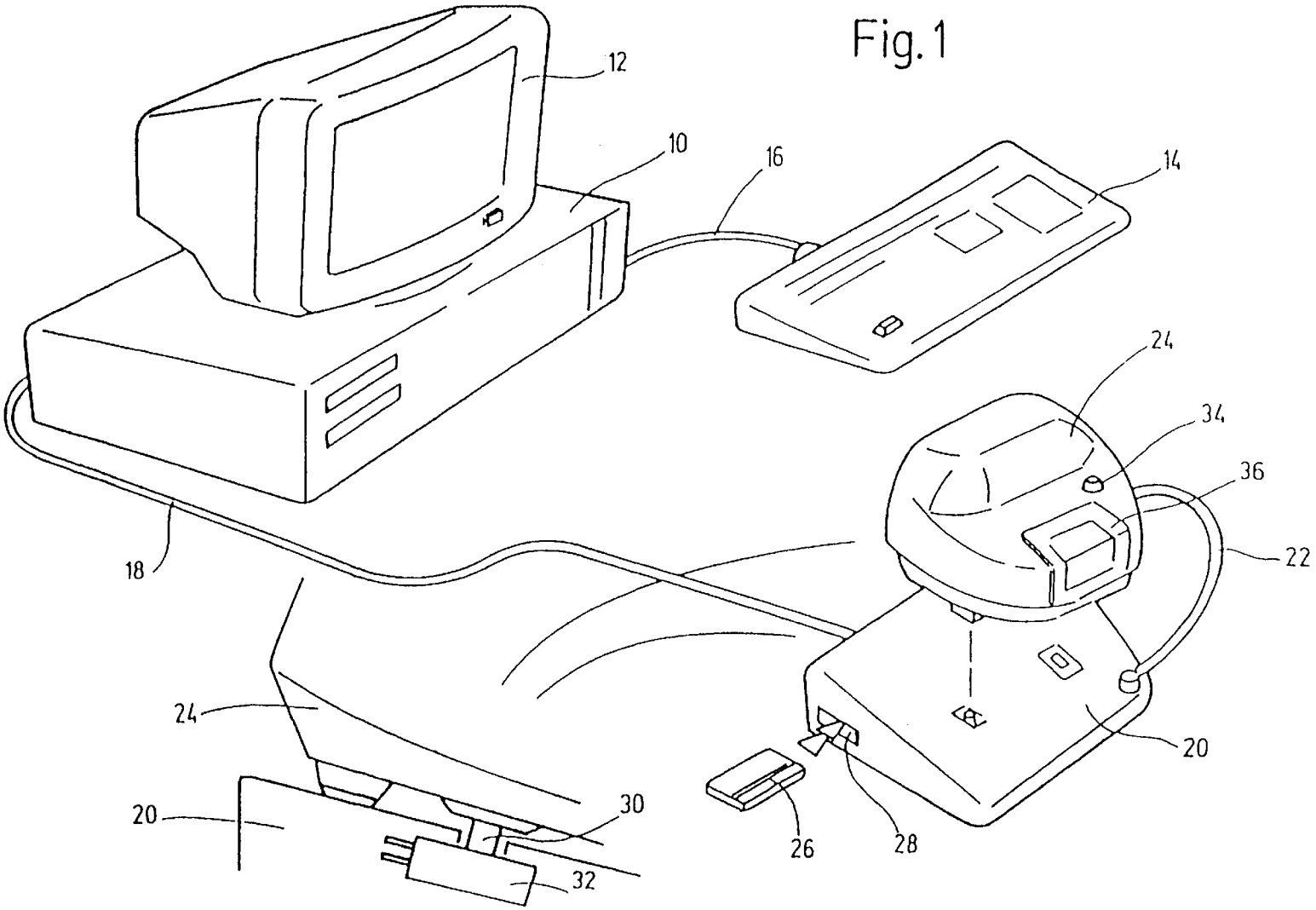
FIG. 1 is a view showing a printer, a base station and a computer.

FIG. 1 shows a printing system consisting of a computer 10, a computer controlled display 12, which is in the described embodiment of the invention a CRT, a keyboard 14 linked to the computer 10 by means of a cable 16, another cable 18, connecting the computer 10 with a base station 20, which is connected to a printer 24 by means of a cable 22. Thus, the printer 24 is linked to the computer 10 via the cables 18,22 and the base station 20.

As known in the prior art, the computer 10 comprises a processor on which software is running, comprising an operating system, a printer driver to enable printing with the printer 24 from the operating system, and a software application by which data can be created, selected and formatted on the PC, for defining image patterns to be printed by the printer 24. The software application can be activated in a number of ways:

- selected by the user at startup or from the desktop: the user places the software application in the start up directory or creates an icon on the desktop;
- from within another application: the user invokes the software application from a button (displayed on the display 12) in or on top of the toolbar of another software application;
- from the handheld printer 24 itself: if the application is not running, the user presses a print button 34 on the hand held printer 24, which will automatically invoke the software application in the first instance.

Another possibility to activate the software application on the computer 10 for controlling the printer 24 is to lift the printer 24 off the base station 20. A switch 32 is provided in the base station 24 sensing the presence or absence of the printer 24 by means of a pin 30. When the printer 24 is placed upon the base station, the pin 30 is depressed, and the switch 32 is closed. In the case that the printer 24 is removed from the base station 20, the pin 30 which is biased in the vertical direction moves upwardly and the switch 32 opens. The switch is connected via some electronic circuits to the computer 18 and activates the software application for printing.

The base station 20 is connected to the computer 10 by means of the cable 18, which can be a parallel or a USB cable. Electric power is supplied to the base station 20 by a separate mains transformer, but could also be supplied from the computer via the cable 18, preferably when the cable 18 is a USB cable. The cable 18 can be hard wired to the base station 20, or connected to a socket on the base station, which is preferably provided at the rear thereof. When the printer 24 is not in use, the handheld printer will be placed in the base station 20. The base station 20 will ensure that the ink jet print head of the printer 24 is protected when not in use by a capping device that will be automatically triggered whenever the printer is inserted into the base station 20. The base station 20 will also cause the print head of the printer 24 to eject ink into a reservoir and mechanically clean the surface of the print head. These measures are necessary to maintain optimum print quality.

The umbilical cable 22 connects the base station 20 to the hand held printer 24, providing both power and data. An LED on the printer will indicate that power is on. The printer 24 is removed from the base station 24 and positioned on the surface to be printed. The length of the cable 22 limits the distance of travel from the base station.

In another embodiment of the invention, the printer is arranged to be disconnected from the base station by unplugging the umbilical cable 22 and moved to another location where printing of the contents of onboard memory, i.e., downloaded image data, can be effected. The user will employ scroll buttons on the printer to select the required print data, which appear in a small LCD. Once a selection has been made, pressing the print button 34 will activate printing. Having selected the data to print using the software application (or the scroll buttons on the printer), the user will activate printing from the print button 34 on the hand held printer 24 itself.

Print alignment is achieved visually through a transparent window 36 in the printer casing. This window 36 can also be opened for inserting an ink cartridge into the printer 24 before use. The cartridge is then clamped in a carriage of the printer 24. The window 36 must be closed before printing; thus there is a switch provided in the housing of the printer for detecting whether the window is closed or not and to trigger the carriage to move into the load/unload position. When the window 36 is not closed, the switch disables printing. Changing a cartridge is achieved by lifting a retaining lever or disengaging a retaining catch and extracting the cartridge in use and replacing this with a new or different color cartridge in the way described above, if the removed cartridge still contains ink and is to be reused it must be capped to avoid the ink drying out.

The printer 24 contains a print mechanism with the ink jet print head having a number of print nozzles, and an ink supply. The print head is moved by means of motor driven scanning means within the housing in two (generally orthogonal) directions such that a rectangular area can be imprinted through an aperture of the printer 24 at the bottom of its housing. Thus, the printer 24 is placed manually on an image receiving medium and—when the print button 34 is depressed—the print head scans over the medium and imprints it by spitting ink droplets onto it.

FIG. 1 shows the presence of a Smart Card reader 28 in the base station 20. Smart cards 26, i.e., memory cards, may be used for storing data or images or as a substitute for additional RAM in the base station.

In another embodiment, a printer is provided which can only be used as a standalone device, i.e., in cooperation with a base station. The functionality of the printer is then as follows: the user removes the printer from the base station. A single button 36 (see FIG. 2) will switch the printer on and off, and a LED on the printer will indicate that power is on. A ROM card containing the selected image data is inserted into the printer. The ROM card is printed with images of its content and the sequence of images provided on the ROM card is indicated numerically on a display of the printer. Thus, the user will select the desired image using scroll buttons to scroll forward or backwards through the numbered content. The user will activate printing from the button 36 on the handheld printer itself.

The print mechanism of the printer will now be described with reference to FIG. 2. The printer 24 has housing, the underside of which can be abutted against the surface of the image receiving medium to be printed. A print face 11 is defined by the scanning range of a ink jet print head cartridge 126 which can be replaced using the cartridge release mechanism described above. The ink jet print head cartridge 126 is mounted for movement along a write axis 128 by virtue of a cooperating lead screw 130 and nut 132. The movement is controlled by a stepper motor 134. The position of the writing axis 128 can be altered by an indexing axis lead screw and bush 136 controlled by a further stepper motor 138. Reference numeral 140 designates a stability bar which extends parallel to the write axis 128, the ink jet print head cartridge 126 being mounted between the write axis 128 and the stability bar 140. Reference numeral 142 designates an indexing axis stability bar and bush.

The printer also includes an electronic controller 100 having a microprocessor for controlling movement of the stepper motor 34 and generating signals for controlling the print head and having a buffer memory for storing data. The microprocessor is capable of converting data from a computer to which the device is connected into a format suitable for driving the print head. The buffer memory can store information in a variety of formats to enable the printer to work with a variety of computer equipment.

In FIG. 3, a printer 24 positioned on an image receiving medium 40 is shown. In order to align the print face 11 on the appropriate position on the image receiving medium 40, the window 36 enables the user to view the position of the print face 11. The window 36 is provided with two distinct areas: a clear area 44 and a frosted area 46. The clear are 44 is rectangular and provided approximately in the center of the window 36, while the frosted area 46 surrounds the clear area 44. These two areas 44,46 are thus located such that the user can see exactly only the print face 11 through the clear area 44, but not the area of the image receiving medium 40 surrounding the print face. The latter area can only be seen through the frosted area 46 of the window 36, it should be noted that an exact distinction between print face 11 and surrounding area can only be made when the user's eye is sufficiently far away from the window 36, avoiding parallax errors. In order to make alignment of the printer 24 easier, additional features are provided in FIG. 3: within the housing of the printer 24, a light source 42 is provided which, when operative, projects a light beam onto the print face 11. In particular, two light sources 42 are provided in FIG. 3, each one of them projecting a beam close to an (e.g., the left resp. right edge) of the print face 11. Thus, the user can see two light spots on the image receiving medium 40 through the window 36, generated by the light sources 42. According to the light spots, alignment of the printer can be easily performed. The light sources can be LEDs (preferably provided with appropriate external or integrated lenses in order to produce a sufficiently focused beam) or solid state lasers, such as semiconductor lasers. Since the light sources will consume a reasonable amount of battery power, it is preferred that they can be switched on by means of a short depression of the print button 34 (not shown in FIG. 3, but see FIG. 1) and are switched off automatically after some time has elapsed, unless the print button 34 is activated again.

An alternative feature to the light sources 42 is indicated in FIG. 3, as well; instead of, or additionally to the light sources, on the top of the housing of the printer 24 a sighting arrangement 42' can be provided, which allows the user to view the print face 11 and comprises two vertically separated reference features, preferably crosshairs. The user's eye views through the sighting arrangement 42' and moves the printer 24 until the two reference features are aligned with each other and with a desired point of the image receiving medium 40. When both sighting arrangements 42' are aligned in the described manner of a gun sight, printing can be performed in the desired location.

Figure 4:
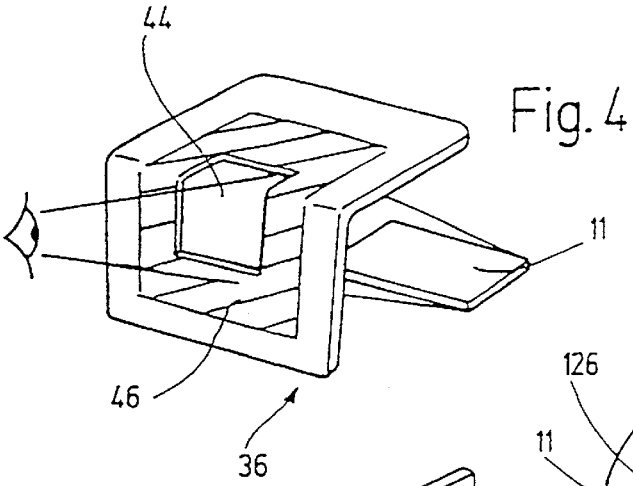
FIG. 4 is a view of a window of a printer.

In FIG. 4, another embodiment of the window 36 is indicated. This window is consisting of a vertically oriented part, and a horizontally oriented part provided at the top of the vertical part. Thus, this window 36 is more rectangular than the rounded window of FIG. 3. The window 36 comprises a clear part 44 and a frosted part 46 for alignment purposes, such that the print face 11 can be viewed through the clear part 44. The window 36 is on its lower boundary hingedly mounted to the housing of the printer 24, and thus be hinged down to provide access to the print head 126. Additionally, the vertical and the horizontal part of the window 36 of FIG. 4 can be hinged to each other, such that the window can be folded down, in order to make access to the print head 126 easier.

Figure 5:
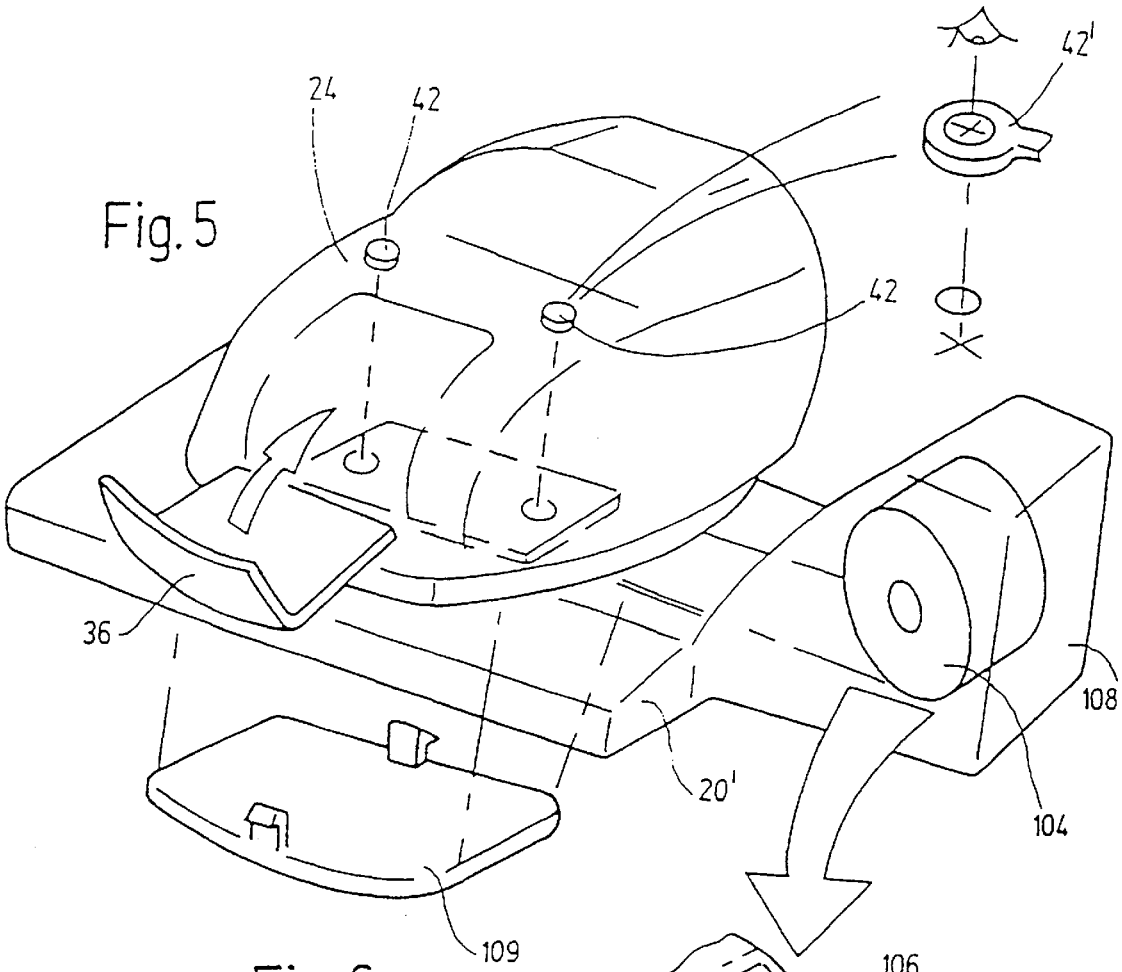
FIG. 5 is a view of the printer mounted on another base station.

FIG. 5 illustrates the printer 24 when placed on an alternative base station 20. The base station 20' contains a supply 104 of labels 102 for printing. In order to prevent the ink cartridge 126 from drying out should the printer 24 not be returned to the base station 20, a sealing lid 109 is attachable to the printer 24 to close the print face 11 in the base of the printer. As can be seen from FIG. 5, the window 36 is hinged to the housing of the printer 24, whereby the window can be releasably hinged, or be fixed to the printer 24. It should be noted that label supply 104 is provided in a cassette 108 releasably mounted to the base station 20, e.g., by hooks engaging into the base station. As known in the prior art, the labels have a rearface provided with an adhesive, and are laminated onto a releasable silicon backing layer. For the purpose of aligning the labels 102 to the print face 11 of the printer 24, alignment marks 106 are printed on the backing layer of the label supply 104 at the center between two adjacent labels 102. The user thus pulls the label strip from the supply 104 until an alignment mark 106 is positioned at a corresponding position of the printer 24, e.g., the left or right edge of its housing, or the left or right edge of the print face 11. Alternatively to the alignment marks 106, holes could be punched into the backing layer of the label supply 104.

The base station 20 of FIG. 5 could also be used for printing on a card-shaped image receiving medium, which can be inserted into the feeding path of the label supply 104 shown in FIG. 5. Such a card-shaped medium could be ID cards. In the case that such ID cards are, e.g., to be laminated after printing with a clear transparent protection layer, the printer could also print alignment marks onto the image receiving medium, in order to make alignment of the printed substrate in a tool for performing a subsequent process (as lamination) easier.

Figure 6:
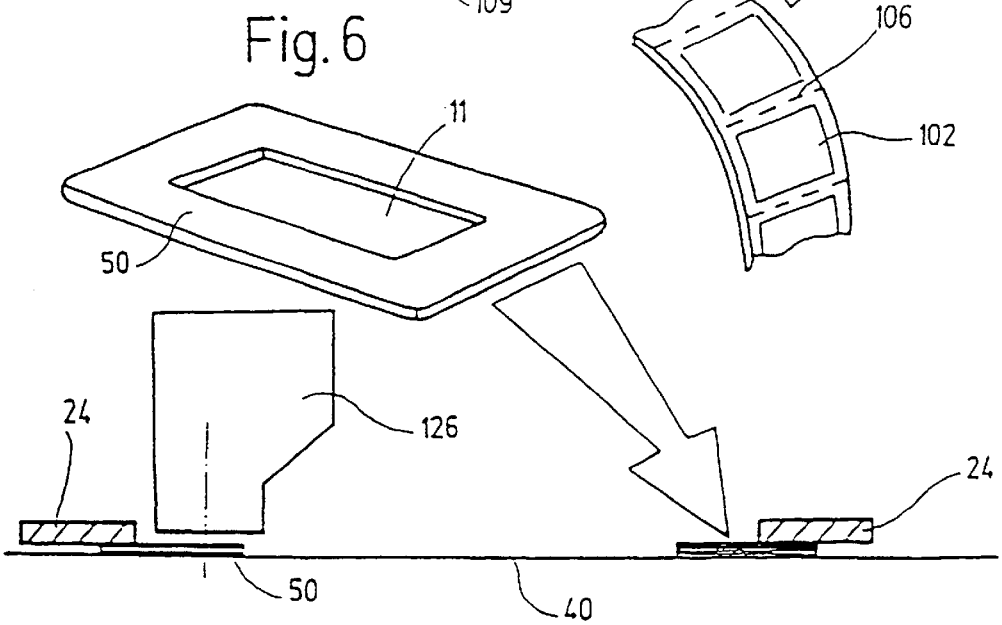
FIG. 6 is a partial section through the printer core.

Another possibility for obtaining alignment of the printer 24 with respect to an image receiving medium 40 is indicated in FIG. 6, showing a section through the bottom part of the printer 24. Reference numeral 50 indicates a thin fixed guide 50 mounted on the bottom face of the printer 24, in the center of which a rectangular aperture is provided. The print face 11 is defined within the rectangular aperture. The purpose of the thin fixed guide 50 is as follows. For optimum print quality, most ink jet print head cartridges 126 must typically be positioned less than 2 mm from the substrate which is less than the thickness of the molded casework defining the housing of the printer 24: As the ink jet print nozzles are positioned within the lower area of the print head cartridge 126, the casework can not extend right up to the print area. The thin fixed guide 50 attached under the print area of the printer 24 allows the print cartridge 126 to pass over the guide 50 to print to the edge of the area defined by the guide 50. Additionally, the guide 50 allows alignment of the printer 24 on the image receiving medium, since it can be viewed through the window 36.

Figure 7:
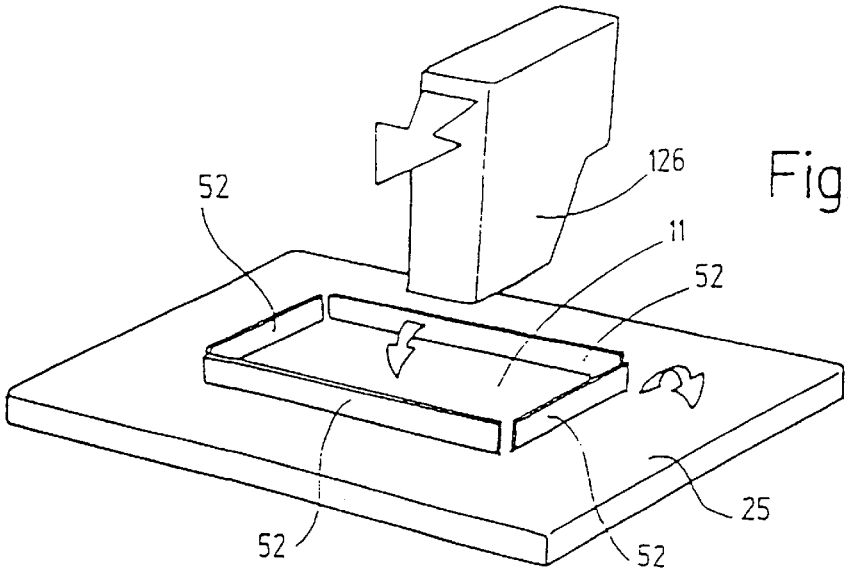
FIG. 7 is a view of a print area guide.

FIG. 7 illustrates an alternative to the arrangement shown in FIG. 6. Reference numeral 25 indicates a bottom plate of the printer 24, defining the bottom face of the printer. At the center of the bottom plate 25, a rectangular aperture is provided, constituting the print face 11 of the printer 24. At the edges of the aperture of the bottom plate, print area guides 52 are hingedly mounted. The print area guides according to the embodiment shown in FIG. 7 are hingedly mounted to the bottom plate 25 and biased such that they are normally aligned vertically upstanding from the plane of the bottom plate, as indicated in FIG. 7. The hinge can be a "live hinge," i.e., provided by the plastics material from which the housing of the printer 24 is molded. When the print head 126 approaches the edges of the print face 11, the print area guides 52 are moved aside by the print head 126, such that they do not affect the range of travel of the print head. The print area guides 52 of FIG. 7 also aid the user during aligning the printer 24 on the image receiving medium, as those shown in FIG. 6.

It should be mentioned that it would be possible to use a template for aligning the printer in the appropriate printing position, as well. Thus, a template made out of paper or cardboard would be provided, in which a rectangle having the size of the printface 11 is cut out. One of the edges of the template (or all of them) would correspond to the outer watts of the housing of the printer. Thus, the user would position the template on the image receiving medium in the appropriate position, then place the printer on the template, remove the template and finally commence printing. Instead of the second step, the user could memorize the position of the edge or edges of the template, remove it, and position the printer accordingly. The template could also be a thin clear PVC sheet which does not require removal. Alternatively a storage compartment could be provided on the base station.

Figure 8B:
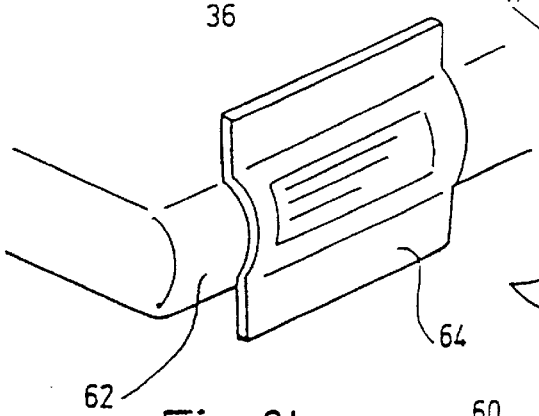
FIG. 8*b* is a view of a shelf edge.
Figure 8A:
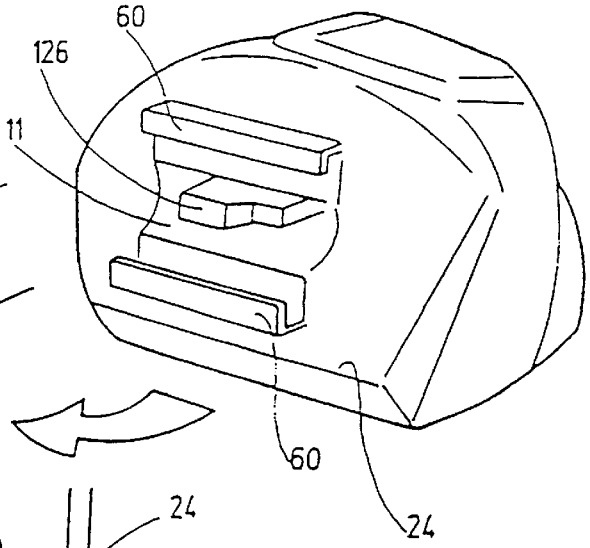
FIG. 8*a* is a view of a printer adapted to print shelf edges.

In FIG. 8*a*, another embodiment of the printer is shown. The main difference to the previously described embodiments is that adjacent both longer sides of the print face 11, two guide hooks 60 are provided. The guide hooks may be releasably mounted to the printer, e.g., by means of screws. The use of the guide hooks is for shelf edge printing.

In FIG. 8*b*, a shelf edge 62 is shown, on which an information label 64 is mounted, for showing a price of products placed on the shelf, or displaying any other information. The label 64 extends generally vertically, and is higher than the shelf as such, such that parts of the label 64 extend below and above the shelf.

Figure 8C:
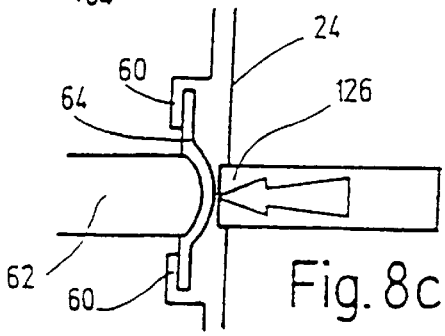
FIG. 8*c* is a view of a printer mounted onto a shelf edge.

In FIG. 8*c*, the printer 24 is shown in a position in which it is mounted to the shelf edge 62. The parts of the label 64 extending above and below the shelf are located with respect to the printer by means of the guide hooks 60. These parts of the label are therefore sandwiched between the bottom of the housing of the printer 24 and the guide hooks 60. The print head 126 is thus operable to print information onto the label, or more particular, onto the surface of the label 64, in order to update price and product information on the label.

Figure 9:
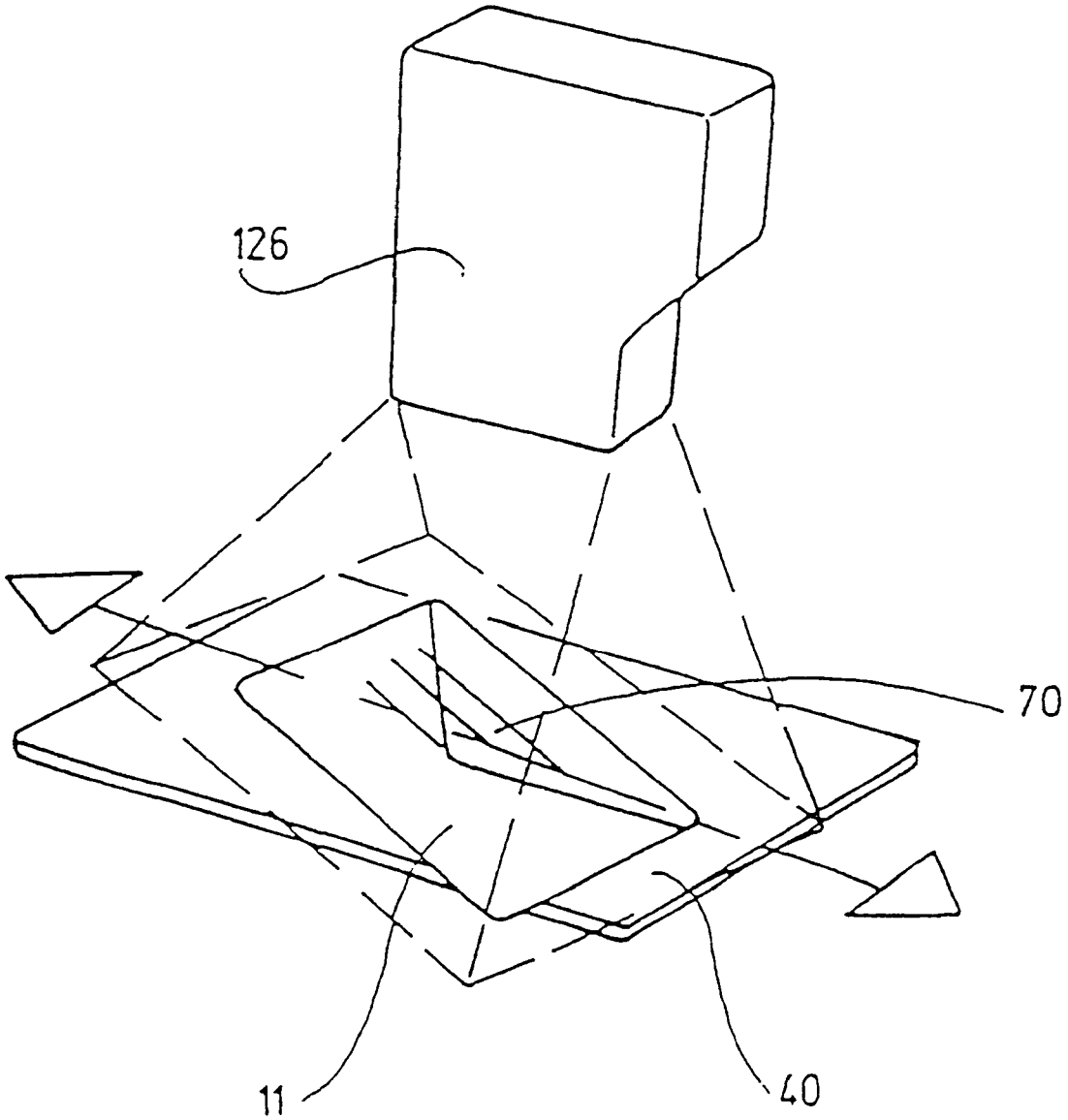
FIG. 9 is a view of a printer with a scanner.

The printer 24 could also be provided with a scanning device for scanning image patterns into a memory, e.g., in order to print them out later. This is illustrated in FIG. 9 In this case, the scanner could be integrated into the print head 126 or mounted to the print head, and the scanner may be used to align the print window with reference features provided on the substrate. Thus, the scanner could scan the printface 11, and be used in order to detect vertical and/or horizontal lines 70 provided on the image receiving medium 40. For this purpose, a controller of the printer would check the stored image data scanned by means of the scanner, and investigate whether straight lines and/or intersections between straight lines are present in the image data. Visual indications could then be presented to the user to help them align the printer 24 with the desired print area. Thus, the printer would have display means indicating the user in which direction the printer 24 should be moved in order to obtain parallelity between the print face 11 and a vertical or horizontal line 70 (or another feature provided on the image receiving medium, as one ore more crosses) detected by the scanner. Examples include arrows on a display of the printer (or a computer to which the printer is connected) or flashing LEDs to indicate in which direction to move the printer for better print alignment, in order to avoid the necessity of a second scan in order to check whether alignment has been performed correctly, it would be possible to equip the printer with a rolling mouse ball as used in a normal PC mouse. Such a ball would allow to gather two dimensional (2D) positional data to provide information as to the motion of the printer 24 relative to the image receiving medium. Since additionally rotational data would be necessary for obtaining the required alignment function (or positional data of two distinct points of the printer), a second ball would have to be used. Data gathered in such a way may be used to assist the user to align the printer.

Figure 10:
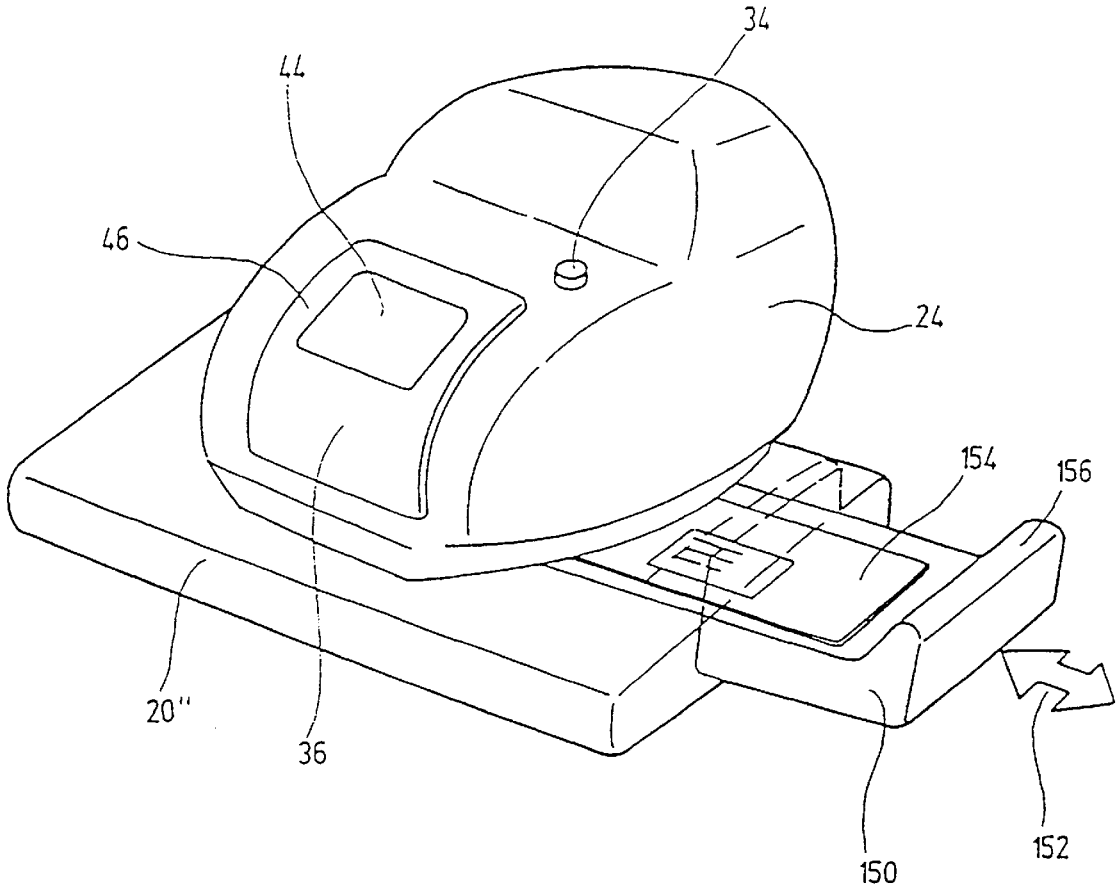
FIG. 10 is a view of a printer mounted on another base station.

Finally, FIG. 10 shows the printer 24 when mounted on a third embodiment of a base station, which is in this drawing denoted with reference numeral 20". While the printer 24 does not significantly differ from the printers previously discussed, the base station 20" comprises a stop 150. The stop 150 is mounted to the main body of the base station 20" on which also the printer is placed. The stop 150 can be shifted by a user in the direction of arrow 152, i.e., towards and away from the printer 24. In order to be able to easily print at desired locations on substrates 154 having different dimensions, as envelopes, the stop 150 is adjustable along the direction indicated by arrow 152. The right edge of the substrate to be printed can hence be aligned on a shoulder 156 of the stop 150. Thus, e.g., address printing can easily be performed at a desired position on an envelope. Preferably, the stop 150 arrests at certain predetermined positions, as stops to be found in a hole punch. It would also be possible to have a single base station with a fixed stop.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A printer comprising:

a housing arranged to be manually positioned on an image receiving medium, the housing being provided with a window;

a print head provided in the housing; and a print face exposed to the image receiving medium, the print face defining a region in which the print head is operable to print a desired pattern onto the image receiving medium, the said window being arranged such that the print face is visible through the window;

wherein the printer further comprises a base station for receiving the housing when the printer is not in use, whereby the print head is protected, the base station having a first cable for providing power and data to the print head and a second cable for connecting the base station to a remote computer.

2. The printer according to claim 1, wherein a means is provided for projecting a light spot onto an image receiving medium.

3. The printer according to claim 2, wherein two light spots are projected onto an image receiving medium, and an imaginary line connecting both spots is oriented parallel to an edge of the print face.

4. The printer according to claim 2, wherein the means for projecting a light spot comprises at least one of an LED and a focusing lens, or a solid state laser.

5. The printer according to claim 1, wherein a sighting arrangement is provided within the housing of the printer, the sighting arrangement arranged such that the print face can be seen through it, and the sighting arrangement comprising two vertically separated reference features.

6. The printer according to claim 5, wherein the two vertically separated reference features are crosshairs.

7. The printer according to claim 5, wherein two sighting arrangements are provided, and an imaginary line connecting both sighting arrangements is oriented parallel to an edge of the print face.

8. The printer according to claim 1, wherein the window comprises a first and a second area, the first area being clear and the second area being frosted.

9. The printer according to claim 8, wherein the first area is approximately rectangular and surrounded by the second area.

10. The printer according to claim 8, wherein the first and second area of the window are arranged such that the print face is visible through the first area.

11. The printer according to claim 1, wherein the window is hingedly mounted to the housing.

12. The printer according to claim 11, wherein the window comprises two parts, which are hingedly mounted together.

13. The printer according to claim 1, wherein the window is releasably mounted to the housing.

14. The printer according to claim 1, wherein the print face is surrounded by a fixed guide, the guide having a thickness to allow movement of the print head within the print face, and said print face is visible through the window.

15. The printer of claim 1, wherein the print face is surrounded by print area guides that are mounted by a hinge, the print area guides being biased such that they are normally aligned vertically upstanding from a plane defined by a print face, and arranged to be moved aside by the print head, with the print area guides being visible through the window.

16. The printer according to claim 15, wherein the hinge is integrally molded with the housing of the printer.

17. The printer of claim 1 wherein the print face is visible through the window when the housing is positioned on an image receiving medium, and wherein the window is non-movable with respect to the housing during printing.

18. A printer comprising:

a housing arranged to be manually positioned on an image receiving medium;

a print head provided in the housing;

a print face exposed to an image receiving medium, wherein the print head is movable within the housing to print onto the image receiving medium in the region of the print face;

a scanner operable to scan the print face to produce image data; and a controller connected to the scanner, the print head and a display, the display being provided within the housing of the printer or external to the printer;

herein the controller is operable to detect markings on an image receiving medium based on the image data, the markings being scanned by the scanner, and the controller is operable to display an information referring to a direction in which the printer is to be moved in order to obtain alignment between the print face and the detected markings.

19. A printer according to claim 18, wherein the scanner is one of mounted to the print head or integrated into the print head.

20. A printer according to claim 18, wherein the controller detects straight lines or intersections between straight lines.

21. A printer according to claim 18, wherein the display shows at least one of arrows or flashing LEDs to indicate the direction to move the printer.

22. A printer according to claim 18, wherein two spaced mouse balls are provided adjacent the print face, the mouse balls being connected to the controller and submitting an information regarding a relative movement between the printer and an image receiving medium to the controller, and the controller being operable to compare the movement measured by the mouse balls with a movement calculated by means of data obtained by the scanner and operable to display an information when the printer has been brought to a position in which the print face is aligned with the detected markings.

23. A combination of an image receiving medium and a printer, the printer comprising:

a housing arranged to be manually positioned on the image receiving medium;

a print head provided in the housing;

a print face exposed to the image receiving medium, the print face defining a region in which the print head is operable to print onto the image receiving medium;

wherein the image receiving medium is a label strip provided with pre-printed or punched alignment marks for aligning the printer to the image receiving medium.

24. A combination of an image receiving medium and a printer, wherein the image receiving medium is an ID card, and the printer comprises:

a housing arranged to be positioned on said ID card;

a print head provided in the housing;

a print face exposed to the ID card, the print face defining a region in which the print head is operable to print onto the ID card; wherein the printer prints alignment marks onto the ID card, said alignment marks being provided for alignment of the ID card in subsequent lamination.

25. A combination of a base station and a printer, the printer comprising:

a housing arranged to be positioned on an image receiving medium;

a print head provided in the housing;

a print face exposed to an image receiving medium, the print face defining a region in which the print head is operable to print onto the image receiving medium;

wherein the printer is arranged to be positioned on the base station, and the base station is provided with a stop arranged to align a print medium on the base station with respect to the printer, with the position of the stop being adjustable and having a number of predetermined positions at which said stop can be arrested.

* * * * *

UNITED STATES PATENT AND TRADEMARK OFFICE

CERTIFICATE OF CORRECTION

PATENT NO. : 6,674,543 B2
DATED : January 6, 2004
INVENTOR(S) : Robert Charles Lewis Day et al.

It is certified that error appears in the above-identified patent and that said Letters Patent is hereby corrected as shown below:

Title page,
Item [75], Inventors, please correct the surname of the eighth inventor:
It should be shown as -- McCleave --

Column 12,
Line 6, please delete "herein" and add -- wherein --

Signed and Sealed this

Eighth Day of June, 2004

JON W. DUDAS
*Acting Director of the United States Patent and Trademark Office*